US009752590B2

(12) United States Patent
Rosinski

(10) Patent No.: US 9,752,590 B2
(45) Date of Patent: Sep. 5, 2017

(54) TWO PUMP DESIGN WITH COPLANAR INTERFACE SURFACE

(71) Applicant: GHSP, Inc., Grand Haven, MI (US)

(72) Inventor: Ryan Rosinski, Whitehall, MI (US)

(73) Assignee: GHSP, Inc., Grand Haven, MI (US)

( * ) Notice: Subject to any disclaimer, the term of this patent is extended or adjusted under 35 U.S.C. 154(b) by 811 days.

(21) Appl. No.: 14/175,090

(22) Filed: Feb. 7, 2014

(65) Prior Publication Data

US 2014/0271123 A1 Sep. 18, 2014

Related U.S. Application Data

(60) Provisional application No. 61/778,721, filed on Mar. 13, 2013.

(51) Int. Cl.
*F04D 29/42* (2006.01)
*F04D 13/14* (2006.01)

(52) U.S. Cl.
CPC ..... *F04D 29/426* (2013.01); *F04D 13/14* (2013.01); *Y10T 29/49236* (2015.01)

(58) Field of Classification Search
CPC ..... F04D 29/426; F04D 13/14
See application file for complete search history.

(56) References Cited

U.S. PATENT DOCUMENTS

| | | | | |
|---|---|---|---|---|
| 2,700,343 A | | 1/1955 | Pezzillo, Jr. | |
| 3,083,893 A | | 4/1963 | Dean | |
| 3,272,129 A | | 9/1966 | Leopold | |
| 4,105,372 A | | 8/1978 | Mishina et al. | |
| 4,164,852 A | | 8/1979 | Anzalone | |
| 4,644,207 A | | 2/1987 | Catterfeld et al. | |
| 4,671,743 A | * | 6/1987 | Frey | F01M 1/02 417/205 |

(Continued)

FOREIGN PATENT DOCUMENTS

| | | | |
|---|---|---|---|
| EP | 0071807 A2 | 2/1983 | |
| SU | 1380617 | 3/1988 | |
| WO | WO 2008062189 A2 * | 5/2008 | E03B 5/02 |

OTHER PUBLICATIONS

International Search Report and Written Opinion of the International Searching Authority dated Apr. 24, 2014 (International Application No. PCT/US2014/015908).

*Primary Examiner* — Gregory Anderson
*Assistant Examiner* — Juan G Flores
(74) *Attorney, Agent, or Firm* — Price Heneveld LLP

(57) ABSTRACT

A multi-pump apparatus includes a first component in a fluid heat transfer system, such as a heat exchanger, the first component including a body portion forming a first interface surface. A pumping component includes a second interface surface. The first and second interface surfaces are planar and combine to define two pump cavities and a planar interface groove supporting a seal ring that extends around the two pump cavities to prevent leakage of fluid from the pump cavities. The pumping component includes a pump impeller in each of the pump cavities and independently-controlled separate motors driving the two pump impellers using an on-board circuit board. One of the first and second components also defines a fluid inlet to and a fluid outlet from each of the pump cavities. Related methods are also defined.

5 Claims, 3 Drawing Sheets

(56) References Cited

U.S. PATENT DOCUMENTS

| | | | | |
|---|---|---|---|---|
| 4,738,584 | A * | 4/1988 | Price | B01F 7/00733 415/203 |
| 5,139,397 | A | 8/1992 | Strelow | |
| 5,178,520 | A * | 1/1993 | Strelow | F04D 13/14 415/148 |
| 5,197,865 | A | 3/1993 | Sevrain et al. | |
| 5,660,149 | A * | 8/1997 | Lakerdas | F01P 5/06 123/41.01 |
| 5,785,013 | A | 7/1998 | Sinn et al. | |
| 6,193,473 | B1 | 2/2001 | Mruk et al. | |
| 6,220,832 | B1 | 4/2001 | Schöb | |
| 6,422,838 | B1 | 7/2002 | Sloteman | |
| 6,672,846 | B2 | 1/2004 | Rajendran et al. | |
| 6,860,349 | B2 | 3/2005 | Ogawa et al. | |
| 7,278,833 | B2 | 10/2007 | Higashiyama et al. | |
| 7,682,136 | B2 | 3/2010 | Donoho, II et al. | |
| 7,704,054 | B2 | 4/2010 | Horvath et al. | |
| 7,942,649 | B2 | 5/2011 | Lesther et al. | |
| 2005/0103286 | A1 | 5/2005 | Ji | |
| 2010/0139582 | A1 | 6/2010 | Bilezikjian et al. | |
| 2010/0262301 | A1 | 10/2010 | Schwartz et al. | |
| 2011/0048390 | A1 | 3/2011 | Washburn | |
| 2011/0052433 | A1 | 3/2011 | Huang | |
| 2011/0116954 | A1 | 5/2011 | Hong et al. | |
| 2011/0120394 | A1 | 5/2011 | Onozawa et al. | |
| 2011/0123370 | A1 | 5/2011 | Kim et al. | |
| 2011/0142690 | A1 | 6/2011 | Shimizu et al. | |
| 2011/0265742 | A1 | 11/2011 | Choi et al. | |

* cited by examiner

TWO PUMP DESIGN WITH COPLANAR INTERFACE SURFACE

CROSS-REFERENCE TO RELATED APPLICATION

This application claims priority to Provisional Patent Application Ser. No. 61/778,721, filed on Mar. 13, 2013, entitled TWO PUMP DESIGN WITH COPLANAR INTERFACE SURFACE, the entire disclosure of which is hereby incorporated by reference in its entirety.

BACKGROUND OF THE INVENTION

The present invention relates to a pump apparatus including a pumping component with two pump cavities formed by mating bodies of the pump apparatus and a component in a fluid transfer system, such as a reservoir or radiator or heat exchanger. The pump apparatus may be used to controllably cool a power generating system of a vehicle along with a secondary heat generating system on the vehicle.

Many factors drive vehicle costs, including cost of individual components, secondary processing, subassembly, and assembly to a vehicle. It is desirable to provide an improved pump design with reduced number of components, reduced cost of manufacturing components, reduced secondary processing, reduced cost of subassembly of the components, and reduced cost of assembling to a vehicle. It is also desirable to design individual components with less multiple critical dimensions and with surfaces that are easier to accurately form and assemble. It is also desirable to provide pump components that are more integrated.

SUMMARY OF THE INVENTION

In one aspect of the present invention, a multi-pump apparatus comprises a first component in a fluid heat transfer system, the first component including a first interface surface, and a pumping component including a second interface surface. The first and second interface surfaces combine to define two pump cavities and a planar interface groove supporting a seal ring that extends around the two pump cavities to prevent leakage of fluid from the pump cavities. The pumping component includes a pump impeller in each of the pump cavities and at least one motor driving the two pump impellers. One or both of the pumping component and the first component also defining a fluid inlet to and a fluid outlet from each of the pump cavities.

In a narrower form, the at least one motor includes two separate and independently controlled electric motors.

In a narrower form, the first component is a fluid reservoir, such as a heat exchanger.

In another aspect of the present invention, a pump apparatus comprises a fluid exchanging component with a fluid reservoir for a fluid transfer system, the fluid exchanging component including a first interface surface, and a pumping component including a second interface surface. The first and second interface surfaces combine to define at least one pump cavity and a planar interface groove supporting a seal ring that extends around the at least one pump cavity to prevent leakage of fluid from the pump cavity. The pumping component includes a pump impeller in the at least one pump cavity and includes at least one motor driving the at least one pump impeller. One or both of the pumping component and the fluid exchanging component also defines a fluid inlet to and a fluid outlet from the at least one pump cavity.

In another aspect of the present invention, a method of connecting two pumps to a fluid transfer system comprises steps of providing a first component in a fluid heat transfer system, the first component including a first planar interface surface. The method includes providing a pumping component including a second planar interface surface, and attaching the pumping component to the first component with the first and second planar interface surfaces combining to define two pump cavities and a planar interface groove supporting a seal ring that extends around the two pump cavities to prevent leakage of fluid from the pump cavities. The pumping component includes a pump impeller in each of the pump cavities and includes at least one motor driving the two pump impellers. One or both of the pumping component and the first component also define a fluid inlet to and a fluid outlet from each of the pump cavities.

In another aspect of the present invention, a multi-pump apparatus comprises a first component including a first interface surface, and a pumping component including a second interface surface. The first and second interface surfaces combine to define first and second pump cavities with a planar interface groove therein that supports a continuous-loop seal ring that extends around the first and second pump cavities. When assembled, the seal ring prevents leakage of fluid outside of an area defined by the first and second pump cavities. The pumping component includes first and second pump impellers in the first and second pump cavities, and includes first and second motors driving the first and second pump impellers, respectively. One or both of the pumping component and the first component also define a fluid inlet to and a fluid outlet from the first and second pump cavities. An on-board control circuit board attached to the pumping component is electrically connected to the first and second motors for controlling independent operation of the first and second motors and hence controlling independent operation of the first and second impellers in the first and second cavities, respectively.

These and other features, advantages, and objects of the present invention will be further understood and appreciated by those skilled in the art by reference to the following specification, claims, and appended drawings.

DETAILED DESCRIPTION

Figure 1:
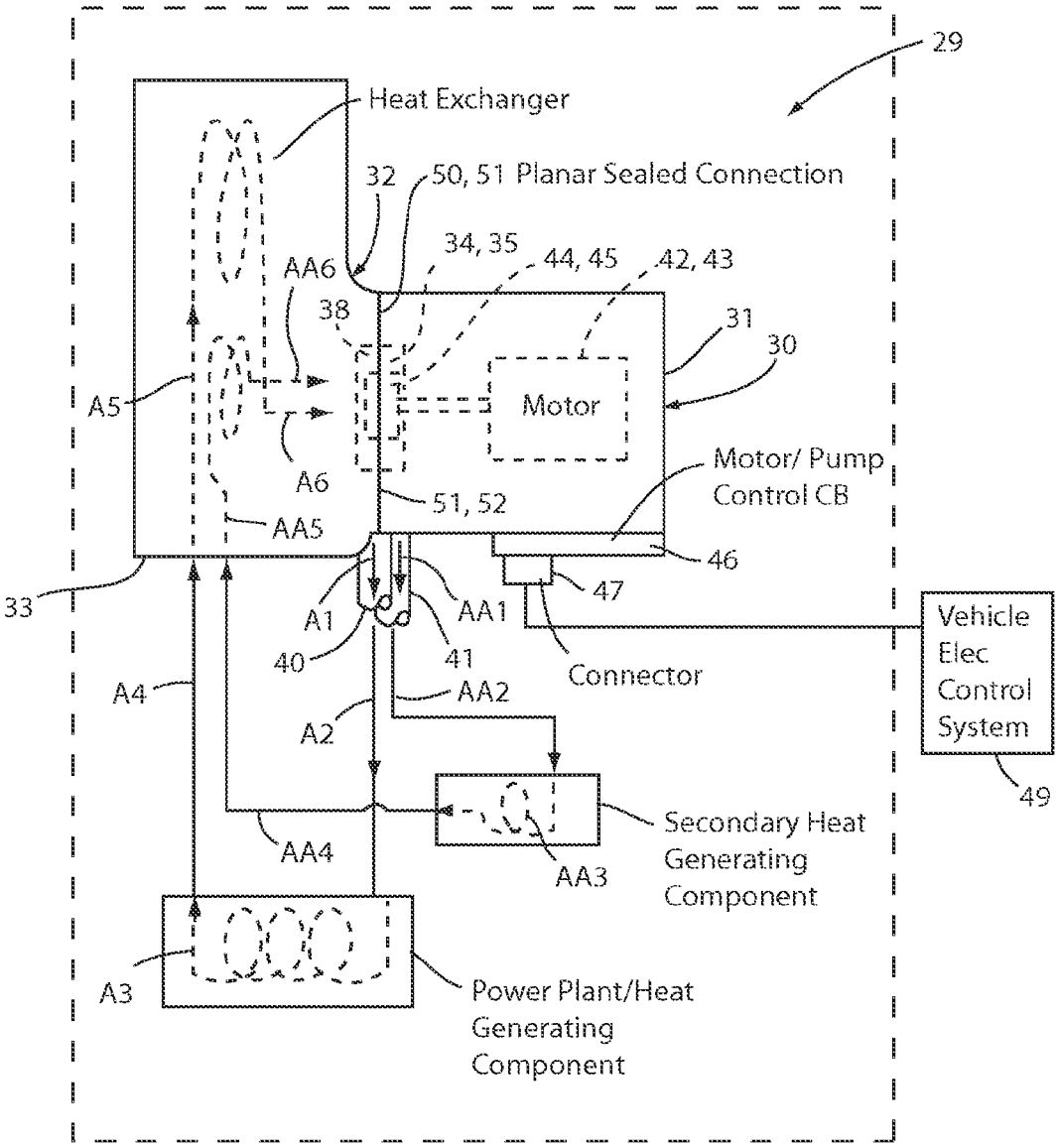
FIG. 1 is a schematic diagram illustrating a heat-transfer fluid system incorporating a dual-pump apparatus embodying the present innovation.
Figure 2:
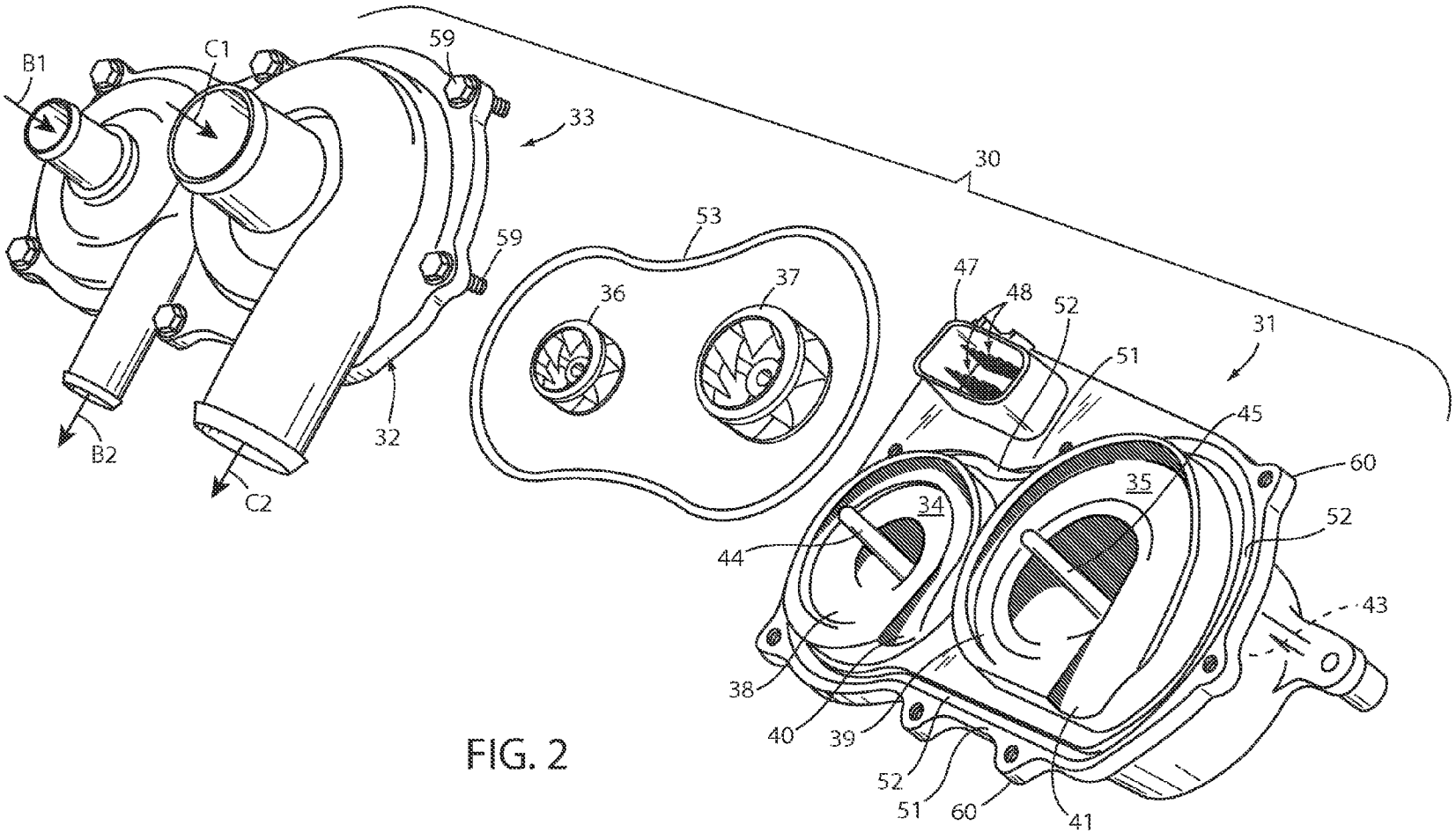
FIGS. 2-4 are exploded-perspective, top, and face views of a body (also called "housing" or "casing") of the pumping apparatus of FIG. 1, FIG. 3 also showing components mated together.

A dual-pump apparatus 29 (FIG. 1) is designed for use in a fluid heat transfer system. The apparatus 29 includes a multi-pump pumping component 30 (FIGS. 1-4) (two pumps being illustrated) having an integrated housing body 31 (also called a "housing component" herein) configured for abutting sealed attachment to a body portion 32 of a second component 33. The second component 33 can be a component of a fluid heat transfer system, and is illustrated in FIG. 1 as a fluid reservoir or heat exchanger component (e.g. a molded end of a vehicle radiator). For example, it is contemplated that the laterally-extending wall forming the attachment flanges (see attachment fasteners 59 in FIG. 2) can be an integral part of a wall of the heat exchanger component, as discussed below. A combination of the housing body 31 and body portion 32 form two pump cavities 34 and 35 on the second component 33. The pumping component 30 includes two pump impellers 36 and 37 positioned in the pump cavities 34 and 35, respectively, driven by motors 42 and 43, thus forming pumps 34/36/42 and 35/37/43. The housing body 31 and body portion 32 (or the body portion 32 alone) also combine to form a fluid inlet 38 and fluid outlet 40 for the cavity 34 and a fluid inlet 39 and fluid outlet 41 for the cavity 35. Arrows A1-A6 in FIG. 1 show a first fluid flow path in the fluid heat transfer system 34, and arrows AA1-AA6 show a second fluid flow path in the system 34. Notably, the paths A1-A6 and AA1-AA6 can be entirely independent fluid circuits, or can include common areas where they mix (such as in the illustrated heat exchange reservoir where flows A5 and AA5 mix). Arrows B1-B2 and C1-C2 in FIGS. 3-4 show the fluid flows through the pump cavities 34 and 35 of two side-by-side circuits in the multi-pump apparatus 30.

Figure 3:
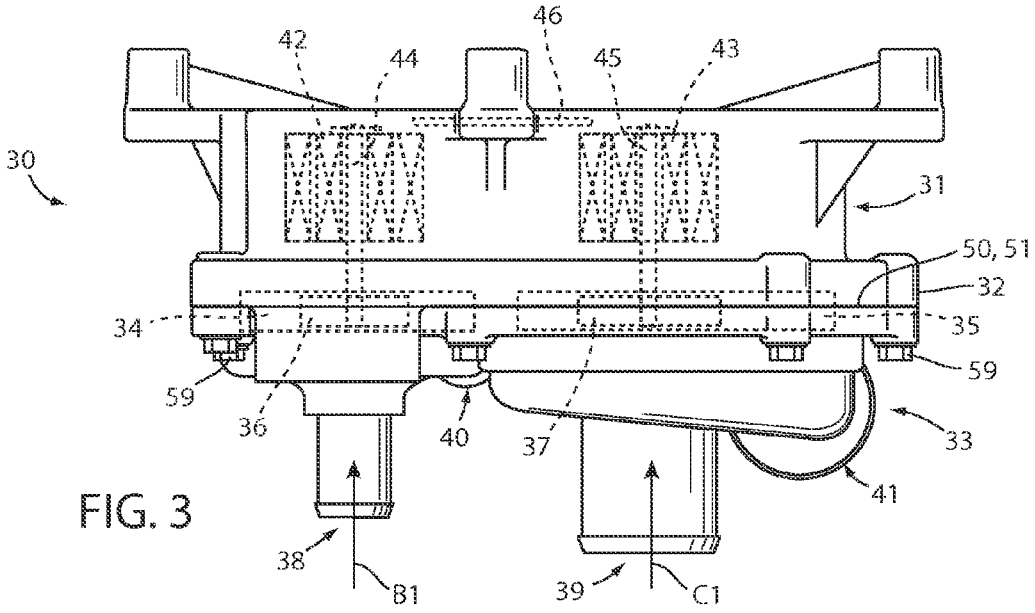
Figure 4:
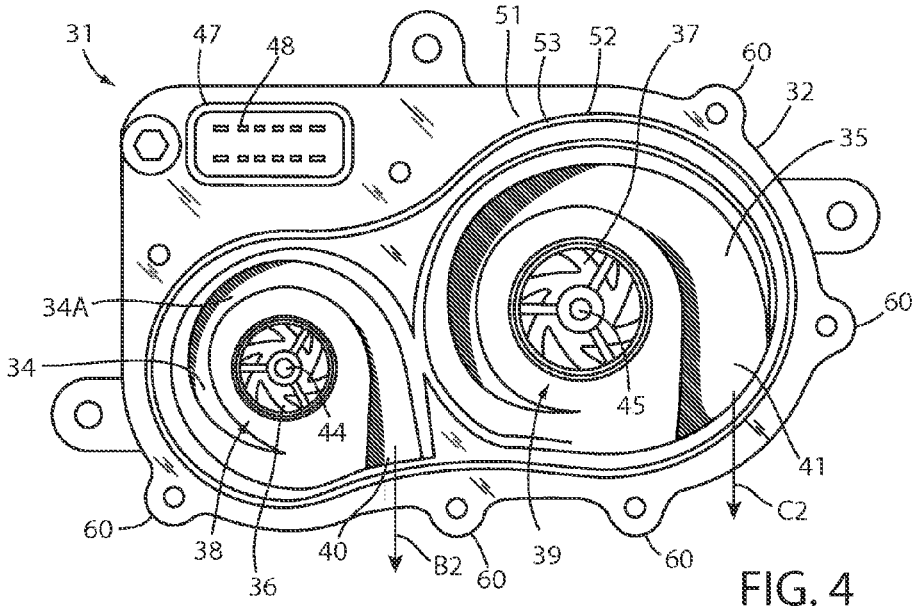

Specifically in FIGS. 3-4, the illustrated body portion 32 of the first component 33 includes a first interface surface 50, and the integrated housing body 31 includes a second interface surface 51. The first and second interface surfaces 50 and 51 combine to define opposing halves of the two pump cavities 34 and 35, and to define a combined planar interface groove 52 supporting a continuous loop seal ring 53 lying in a single plane that extends around the two pump cavities 34 and 35 to prevent leakage of fluid from the pump cavities 34 and 35. (It is contemplated that the groove 52 can be formed equally in surfaces 50/51, or formed unequally in the surfaces 50/51, or can be fully formed in only one of the surfaces 50/51.) The seal 53 is a continuous loop, preformed or not preformed, and can have a circular cross section or a non-circular cross section, but lies in a single plane, such that it is designed for easy placement during assembly and optimal/reliable sealing capability.

The separate motors 42 and 43 are formed in the housing body 31. The motors 42 and 43 ride on shafts 44 and 45, respectively, with the shafts 44/45 extending into the impellers 36 and 37 so that the motors 42 and 43 independently drive the two pump impellers 36/37, respectively. For example, the stator of the motors 42 and 43 can be insert molded into the housing body 31. A controller is provided in housing body 31, such as a circuit board(s) 46 with sub-circuits (e.g. on a same or piggyback circuit boards) that independently controls each of the motors 42 and 43. A multi-lead interface is connected to the circuit board 46 and includes conductors extending to a multi-lead connector 47 with multiple pins 48 adapted for connection to a mating multi-lead connector (not specifically shown) that is connected to a vehicle control system 49 (FIG. 1) and in turn connected to heat and pressure sensors in the vehicle. Control of motors 42 and 43 is provided by the on-board controller (i.e. circuit board 46) with pumping demand and overall operation being controlled and provided by the vehicle control system 49.

As noted above, the body portion 32 (FIG. 1) of the first component 33 and the housing body 31 include planar interface surfaces 50/51 defining the planar interface groove 52 supporting the continuous seal ring 53. During attachment, fasteners 59 are extended through apertured bosses 60 and when tightened, compress the seal ring 53 in a manner preventing fluid leakage from the cavities 34 and 35. By this arrangement, the seal 53 can be a single planar pre-formed loop of sealing material with circular cross section, which is relatively low cost and easily positioned and that provides a very reliable seal. Nonetheless, it is contemplated that other seal constructions can be used, such as preformed, not-preformed, non-circular cross section, and/or liquid-applied sealant material applied during assembly.

Figure 5:
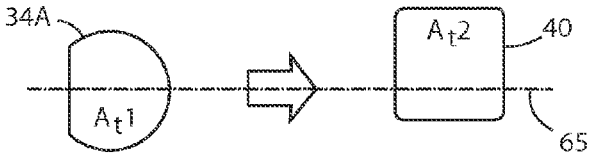
FIG. 5 are cross sectional views showing the pump cavity volute with a cross section at location 34A which is on an interface plane ("centerline") and also showing an exit opening with a cross section at location 40 which is positioned offset and above the interface plane (shown as a dash-dot line) into the input/output body for optimal throat area and for pump efficiency.

A size and dimensional shape and relative location of the illustrated volute of the pump cavity 34 varies along its length, as shown by location 34A (see FIG. 5 showing the cross section formed mid-way along the volute's length) and at the exit opening 40 relative to the interface plane (see FIG. 5 showing the cross section at the exit opening). Notably, a position of the volute's cross section may vary along its length, as illustrated by a relative location of the interface plane to the volute as shown by the dash-dot line in FIG. 5. The coplanar interface feature of the present innovation is achieved in part through resizing the exit perimeter dimensions to maintain an optimal throat area at the best efficiency point of the pump design. This allows the exit ports to be repositioned above the "center line" (or above the "central plane") of the pump, which permits the volute to be split below the pump center line 65 and still maintain manufacturability.

Surfaces forming the volute are continuous, but define a continuously changing cross sectional shape. As shown in FIG. 5, the volute cross section at location 34A is substantially circular (though with a flat side section that extends across an 80 to 90 degree arc on an outer diameter) and is centered on the centerline 65 of the planar interface of surfaces 50/51 (FIG. 3). Contrastingly, the exit opening 40 is substantially a square cross section (though with small-radiused corners), and is positioned with about 70%-90% (or more preferably about 75%-80% off set from the centerline 65 (FIG. 5) of the interface surfaces 50/51 toward the body of first component 33. The cavity 35 and exit opening 41 are similar in shape to cavity 34 and opening 40, but proportionately larger in shape to handle a larger/different volume of heat transfer fluid. They are also offset from the centerline 65. Notably, the motor 43 is also proportionately larger and/or stronger as necessary to power the proportionately larger impeller 37. It is noted that the volute's changing cross section and the design of pump impellers 36,37 can be designed to meet functional requirements of a particular application, as will be understood by persons skilled in this art. It is also contemplated that more than two pumps can be designed into a given apparatus (30) if desired.

It is contemplated that the component 31 can be part of any component of a fluid delivery system. The illustrated component 31 is intended to represent a molded part of a fluid reservoir, such as an end piece forming the end of a vehicle radiator. In particular, it is contemplated that the laterally-extending wall in body portion 32 (i.e. that part forming the attachment flanges for receiving the fasteners 59 in FIG. 2) can be an integral part of (or can be fastened to) a molded plastic part forming an end (wall) of a vehicle radiator (i.e. the heat exchanger component).

The illustrated body portion 32 is particularly shaped so that the molded plastic body part 32 can be injection molded with minimal (or zero) molding die pulls and with minimal (or zero) molding die slides, since it does not include "blind" surfaces that must be formed, as will be understood by persons skilled in this art. Also, the body portion 32 is well-designed to have relatively consistent wall thicknesses and to avoid large masses of material, which if present would tend to cause sinks and other cooling difficulties in injection molding dies resulting in slower molding cycle times and less accurate moldings. More specifically, the illustrated body portion 32 has a relatively non-complex shape and construction, which non-complex shape and straightforward construction makes it much easier to maintain a planar shape of the interface surface 40 during the molding process.

It is contemplated that the component 33 can be any part forming a subcomponent of a heat transfer component, especially one including a fluid reservoir. Further, it is contemplated that the component 31 can be a stand-alone cover component attached to the pumping component 33 and forming half of the two pump cavities and providing inlet and outlets to each pump cavity.

The integrated housing body 31 forms a pump housing or casing, and is molded of a structural material suitable for the fluid being pumped and for forming a casing for the pump and motor apparatus 30. It is contemplated that it can be made in different ways and to include different materials and structures. The illustrated body 31 is injection molded using insert molding techniques to enclose and fix the stator of the adjacent electric motors 42, 43, with each motor's rotor positioned inside and riding on a center shaft 44, 55, respectively. The first component 33 is similarly injection molded. A person skilled in the art of pump design and motor design will understand the present innovation by the present description. However, for further discussion, the reader's attention is directed to U.S. patent application Ser. No. 13/664,758, entitled DUAL PUMP AND MOTOR WITH CONTROL DEVICE, Oct. 31, 2012, which is owned by the assignee of the present application, and which the entire teachings and disclosure are incorporated herein by reference.

A method of assembly includes a dual pump and motor control subassembly with at least two impellers and at least one motor configured to drive the at least two impellers, configured such that the subassembly containing the two impellers has a monoplanar sealing area. The mono-planar sealing area is sealably mated to any single planed surface of the vehicle, especially to the engine or a remote cooling subsystem component. The configuration of the seal being on the same plane allows a single seal to be used for a direct mounting of the dual pump into a vehicle. In this way, a dual pump assembly can be provided with either a separate set of flow volutes for external mounting to a vehicle, or a dual pump subassembly can be provided for direct mounting to a vehicle subsystem in a way that minimizes the sealing areas for ingress or egress, e.g. for use in automotive applications.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A cooling system, comprising:

separate first and second heat transfer systems each including heat transfer components; and a dual pump apparatus having a first pump connected to the first heat transfer system for pumping fluid through the first heat transfer system, and having a second pump connected to the second heat transfer system for pumping fluid through the second heat transfer system;

the dual pump apparatus, comprising:

a housing body supporting first and second motors;

a second component including a body portion, the second component being one of a fluid reservoir and a heat exchanger component;

the housing body and the second component including interfacing surfaces that combine to define adjacent separate pump cavities, a fluid inlet and a fluid outlet to each of the separate pump cavities, and an interface groove that extends continuously around the adjacent separate pump cavities; and first and second impellers connected to the first and second motors, respectively, and located in the separate pump cavities, the first impeller and first motor forming the first pump and the second impeller and second motor forming the second pump;

wherein the second component is integrally formed into a wall of a heat exchanger in the first heat transfer system.

2. The cooling system of claim 1, including:

an on-board control circuit board attached to the pumping component and electrically connected to the first and second motors for controlling independent operation of the first and second motors and hence controlling independent operation of the first and second impellers in the first and second cavities, respectively.

3. The cooling system of claim 1, wherein the wall includes side surfaces defining part of each of the adjacent separate pump cavities.

4. The cooling system of claim 1, wherein the housing body is molded, and wherein the first and second motors include first and second stators, respectively, that are insert molded into the housing body.

5. The cooling system of claim 1, wherein the interface groove is planar.

* * * * *